US009970381B2

(12) United States Patent
Schmidbauer

(10) Patent No.: US 9,970,381 B2
(45) Date of Patent: May 15, 2018

(54) FUEL INJECTION SYSTEM

(71) Applicant: Continental Automotive GmbH, Hannover (DE)

(72) Inventor: Thomas Schmidbauer, Falkensein (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 0 days. days.

(21) Appl. No.: 15/021,209

(22) PCT Filed: Jun. 11, 2014

(86) PCT No.: PCT/EP2014/062092
§ 371 (c)(1),
(2) Date: Mar. 10, 2016

(87) PCT Pub. No.: WO2015/055326
PCT Pub. Date: Apr. 23, 2015

(65) Prior Publication Data

US 2016/0222906 A1 Aug. 4, 2016

(30) Foreign Application Priority Data

Oct. 15, 2013 (DE) ..... 10 2013 220 780

(51) Int. Cl.
*F02D 41/38* (2006.01)
*F02D 41/30* (2006.01)
(Continued)

(52) U.S. Cl.
CPC ..... *F02D 41/3845* (2013.01); *F02D 41/3082* (2013.01); *F02D 41/3809* (2013.01);
(Continued)

(58) Field of Classification Search
CPC ..... F02D 41/3845; F02D 41/3809; F02D 41/1401; F02D 41/40; F02D 41/3827;
(Continued)

(56) References Cited

U.S. PATENT DOCUMENTS 5,697,343 A * 12/1997 Isozumi ..... F02D 41/3827 123/446
6,314,945 B1 * 11/2001 Sugiyama ..... F02D 41/08 123/299
(Continued)

FOREIGN PATENT DOCUMENTS

DE 10224813 A1 12/2003 ..... F02D 41/38
DE 102006001230 A1 7/2006 ..... F02D 41/22
(Continued)

OTHER PUBLICATIONS

Korean Office Action, Application No. 2017016942309, 9 pages, dated Mar. 7, 2017.
(Continued)

*Primary Examiner* — Lindsay Low
*Assistant Examiner* — George Jin
(74) *Attorney, Agent, or Firm* — Slayden Grubert Beard PLLC

(57) ABSTRACT

A fuel-injection system comprises a control unit that controls the injection of a fuel cylinder of an engine such that an injection volume of the fuel is injected into one of the cylinders during each work cycle of the engine. To this end, the control unit actuates an inlet valve and/or outlet valve such that, during pump strokes of a high-pressure pump which follow one another, a different high-pressure volume of the fuel per pump stroke is delivered into a pressure accumulator during at least two consecutive work cycles. The high-pressure volume that is produced per work cycle corresponds to the injection volume that is removed from the
(Continued)

pressure accumulator per work cycle and is constant during each of the consecutive work cycles.

10 Claims, 3 Drawing Sheets

(51) Int. Cl.
*F02M 59/36* (2006.01)
*F02M 63/02* (2006.01)
*F02D 41/20* (2006.01)

(52) U.S. Cl.
CPC ..... *F02M 59/366* (2013.01); *F02M 63/025* (2013.01); *F02D 2041/2027* (2013.01)

(58) Field of Classification Search
CPC ..... F02D 41/401; F02D 41/3082; F02D 2041/2027; F02D 2700/0284; F02D 2200/0602; F02D 2200/503; F02M 59/366; F02M 59/20; F02M 63/025; F02M 63/0225; F02M 63/0007
See application file for complete search history.

(56) References Cited

U.S. PATENT DOCUMENTS

| | | | | |
|---|---|---|---|---|
| 7,422,002 | B2 * | 9/2008 | Mueller | F02D 41/3845 123/458 |
| 7,726,284 | B2 | 6/2010 | Hori | 123/501 |
| 2006/0147317 | A1 * | 7/2006 | Okamoto | F02D 41/3845 417/297 |
| 2008/0035118 | A1 * | 2/2008 | Toyohara | F02D 41/3836 123/478 |
| 2008/0098991 | A1 | 5/2008 | Eddy | 123/504 |
| 2013/0213361 | A1 * | 8/2013 | Zeng | F02M 63/0265 123/446 |
| 2016/0177842 | A1 * | 6/2016 | Riepl | F02D 41/3845 123/457 |

FOREIGN PATENT DOCUMENTS

| | | | | |
|---|---|---|---|---|
| EP | 0898074 | A1 | 2/1999 | F02M 39/02 |
| EP | 1741912 | A2 | 1/2007 | F02D 41/40 |
| EP | 2503132 | A2 | 9/2012 | F02D 41/38 |
| JP | 11182310 | A | 7/1999 | F02D 41/38 |
| JP | 2000008997 | A | 1/2000 | F02D 41/02 |
| JP | 2009108783 | A | 5/2009 | F02D 41/22 |
| WO | 2015/055326 | A1 | 4/2015 | F02D 41/38 |

OTHER PUBLICATIONS

Japanese Office Action, Application No. 2016505859, 4 pages, dated Mar. 13, 2017.
German Office Action, Application No. 102013220780.8, 7 pages, dated Apr. 30, 2014.
International Search Report and Written Opinion, Application No. PCT/EP2014/062092, 11 pages, dated Dec. 5, 2014.
Chinese Office Action, Application No. 201480025279.7, 14 pages, dated Mar. 24, 2017.

* cited by examiner

FUEL INJECTION SYSTEM

CROSS-REFERENCE TO RELATED APPLICATIONS

This application is a U.S. National Stage Application of International Application No. PCT/EP2014/062092 filed Jun. 11, 2014, which designates the United States of America, and claims priority to DE Application No. 10 2013 220 780.8 filed Oct. 15, 2013, the contents of which are hereby incorporated by reference in their entirety.

TECHNICAL FIELD

The invention relates to a fuel injection system, in particular a common rail fuel injection system.

BACKGROUND

In a common rail fuel injection system, the injection pressure can be produced independently of the engine speed and the injection quantity. The decoupling of pressure production and injection is accomplished by means of a pressure reservoir (rail). To produce the pressure, a high-pressure pump (HDP) is provided, which delivers the fuel into the pressure reservoir. The high-pressure pump can be connected to a tank by a fuel inlet duct and to the pressure reservoir by a fuel outlet duct. The high-pressure pump compresses the fuel fed in from the fuel inlet duct and, in a pump working space, produces a high-pressure volume of the fuel, which is discharged to the pressure reservoir. In the injection of fuel into a cylinder, an injection volume of the fuel is taken from the pressure reservoir.

An inlet valve is arranged ahead of the high-pressure pump in the fuel inlet duct. An outlet valve is provided after the high-pressure pump in the fuel outlet duct. In addition to passive valves, which open and close in accordance with a pressure, the inlet and outlet valve can each be configured as an active valve. The purpose of conventional active valves is to control the volume flow which is actually available for the production of high pressure in such a way that neither an excess nor a lack of high-pressure volume flow arises. The volume flow at the high-pressure outlet of the high-pressure pump exhibits oscillations dependent on the stroke frequency, depending on the delivery properties of a piston pump. Moreover, the periodic opening and closure of the inlet valve leads to noise, the frequency of which is a function of the speed of a drive shaft of the high-pressure pump.

SUMMARY

One embodiment provides a fuel-injection system comprising a high-pressure pump having a pump working space and a pump piston for compressing a fuel in the pump working space; a pressure reservoir for supplying the fuel for injection into cylinders of an engine; an inlet valve for allowing the fuel into the high-pressure pump; an outlet valve for allowing the fuel out of the high-pressure pump; and a control unit for controlling the injection of the fuel into the cylinders and for controlling at least one of the inlet valve and the outlet valve; wherein the high-pressure pump is coupled to the pressure reservoir via the outlet valve; wherein the control unit controls the injection of the fuel into the cylinders in such a way that an injection volume of the fuel is taken from the pressure reservoir and injected into in each case one of the cylinders during a work cycle of the engine; wherein the high-pressure pump is configured to deliver a high-pressure volume of the fuel into the pressure reservoir during the work cycle of the engine; wherein the high-pressure pump is configured in such a way that the pump piston performs a complete up-and-down motion in the pump working space during a pump stroke; wherein the control unit is configured to control the at least one of the inlet valve and the outlet valve in such a way that the high-pressure volume of the fuel produced by the high-pressure pump during the work cycle of the engine corresponds to the injection volume of the fuel taken from the pressure reservoir during the work cycle, and a different high-pressure volume of the fuel per pump stroke is delivered into the pressure reservoir during successive pump strokes during at least two successive work cycles; wherein the control unit controls the injection of the fuel into the cylinders in such a way that the injection volume taken from the pressure reservoir is constant during each of the successive work cycles.

In a further embodiment, the control unit is configured to control the at least one of the inlet valve and the outlet valve in such a way that the respective high-pressure volume of the fuel produced by the high-pressure pump during each of the successive work cycles of the engine corresponds to the injection volume of the fuel taken from the pressure reservoir during each of the successive work cycles of the engine.

In a further embodiment, the control unit is configured to control the at least one of the inlet valve and the outlet valve in such a way that the at least one of the inlet valve and the outlet valve is opened and closed at different times during the successive work cycles of the engine.

In a further embodiment, the control unit is configured to control the at least one of the inlet valve and the outlet valve in such a way that times between a first successive opening and/or closure of the at least one of the inlet valve and the outlet valve and a second successive opening and/or closure of the at least one of the inlet valve and the outlet valve are different.

In a further embodiment, the control unit is configured to set the times between a first successive opening and/or closure of the at least one of the inlet valve and the outlet valve and a second successive opening and/or closure of the at least one of the inlet valve and the outlet valve in such a way that noise emissions which arise during the opening and/or closure of the at least one of the inlet valve and the outlet valve are below a limit value.

Another embodiment provides a method for injecting fuel into cylinders of an engine, comprising providing a high-pressure pump having a pump working space and a pump piston for compressing a fuel in the pump working space, providing a pressure reservoir for supplying the fuel for injection into the cylinders of the engine, providing an inlet valve for allowing the fuel into the high-pressure pump and providing an outlet valve for allowing the fuel out of the high-pressure pump; producing a high-pressure volume of the fuel in the high-pressure pump during a work cycle of the engine; delivering the high-pressure volume of the fuel into the pressure reservoir by the high-pressure pump during the work cycle of the engine; and injecting an injection volume of the fuel into one of the cylinders during the work cycle of the engine; wherein the high-pressure volume of the fuel produced by the high-pressure pump during the work cycle corresponds to the injection volume of the fuel taken from the pressure reservoir during the work cycle; wherein a different high-pressure volume of the fuel per pump stroke is delivered into the pressure reservoir during successive pump strokes during at least two successive work cycles;

and wherein the injection volume taken from the pressure reservoir is constant during each of the successive work cycles.

In a further embodiment, the respective high-pressure volume of the fuel produced by the high-pressure pump during successive work cycles corresponds to the injection volume of the fuel taken from the pressure reservoir during each of the successive work cycles.

In a further embodiment, during the successive work cycles of the engine, the at least one of the inlet valve and the outlet valve is opened and closed at different times during the successive work cycles of the engine.

In a further embodiment, times between a first successive opening and/or closure of the at least one of the inlet valve and the outlet valve and a second successive opening and/or closure of the at least one of the inlet valve and the outlet valve are different.

In a further embodiment, the times between a first successive opening and/or closure of the at least one of the inlet valve and the outlet valve and a second successive opening and/or closure of the at least one of the inlet valve and the outlet valve are set in such a way that noise emissions which arise during the opening and/or closure of the at least one of the inlet valve and the outlet valve are below a limit value.

BRIEF DESCRIPTION OF THE DRAWINGS

Example embodiments of the invention are explained in greater detail below with reference to figures, in which.

DETAILED DESCRIPTION

Figure 1:
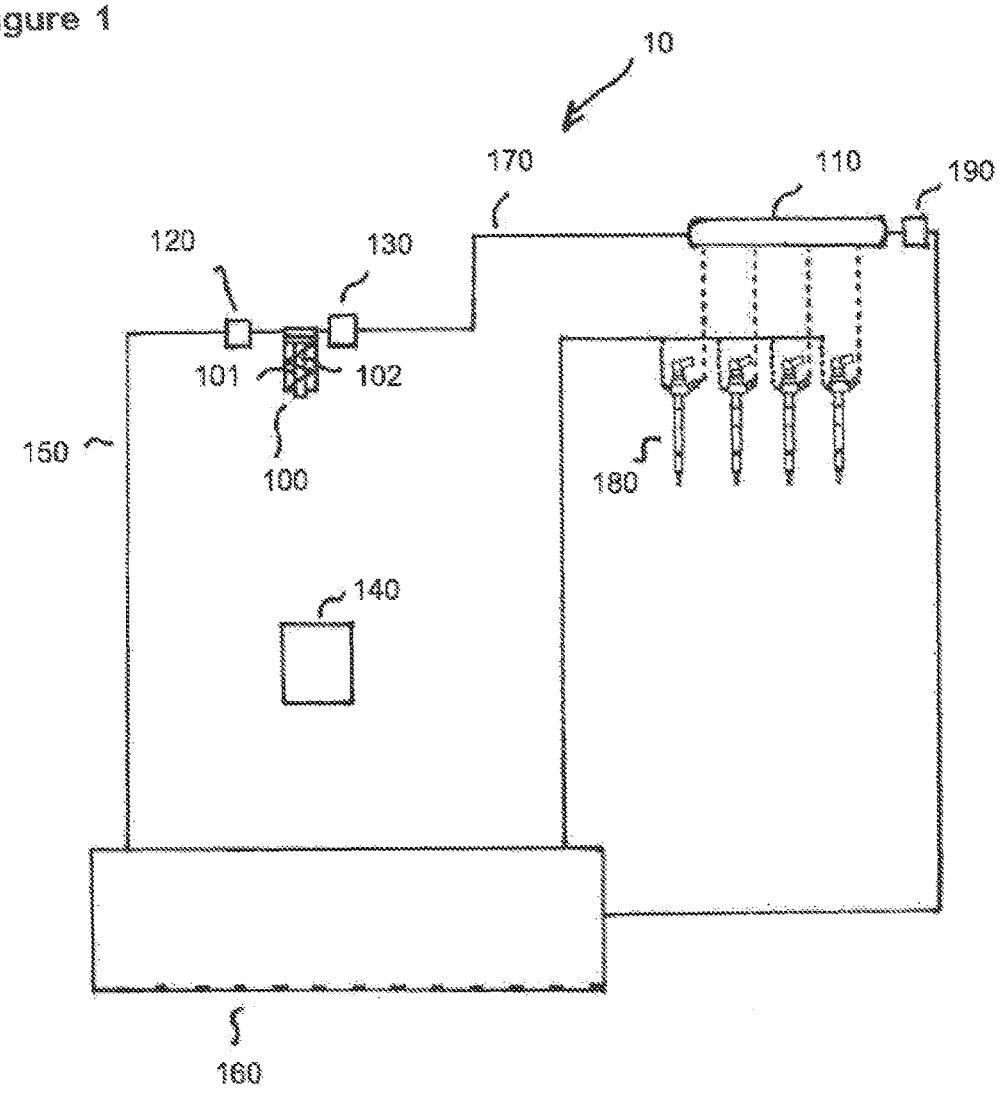
FIG. 1 shows an embodiment of a fuel injection system.

Embodiments of the present invention allow pump delivery in synchronism with injection. Further, embodiments of the invention attempt to minimize operating noise which occurs during the periodic opening and closure of the inlet and/or outlet valve.

One embodiment provides a fuel injection system having pump delivery by a high-pressure pump in synchronism with injection. The fuel injection system comprises a high-pressure pump having a pump working space and a pump piston for compressing a fuel in the pump working space, a pressure reservoir for supplying the fuel for injection into cylinders of an engine, an inlet valve for allowing the fuel into the high-pressure pump and an outlet valve for allowing the fuel out of the high-pressure pump. Moreover, the fuel injection system has a control unit for controlling the injection of the fuel into the cylinders and for controlling at least one of the inlet valve and the outlet valve. The high-pressure pump is coupled to the pressure reservoir via the outlet valve. The control unit controls the injection of the fuel into the cylinders in such a way that an injection volume of the fuel is taken from the pressure reservoir and injected into in each case one of the cylinders during a work cycle of the engine. The high-pressure pump is configured to deliver a high-pressure volume of the fuel into the pressure reservoir during the work cycle of the engine. Moreover, the high-pressure pump is configured in such a way that the pump piston performs a complete up-and-down motion in the pump working space during a pump stroke. The control unit controls the at least one of the inlet valve and the outlet valve in such a way that the high-pressure volume of the fuel produced by the high-pressure pump during the work cycle of the engine corresponds to the injection volume of the fuel taken from the pressure reservoir during the work cycle, and a different high-pressure volume of the fuel per pump stroke is delivered into the pressure reservoir during successive pump strokes during at least two successive work cycles. The control unit controls the injection of the fuel into the cylinders in such a way that the injection volume taken from the pressure reservoir is constant during each of the successive work cycles.

The fuel injection system indicated allows pump delivery in synchronism with injection. This means that the high-pressure volume of the fuel fed to the pressure reservoir by the high-pressure pump in each work cycle corresponds to the volume of the fuel which is taken from the pressure reservoir as an injection volume for injection into a cylinder during the work cycle. The high-pressure volume of the fuel can thus be produced in accordance with requirements by the high-pressure pump in each work cycle of the engine.

For this purpose, the functionality of the inlet valve, e.g. a digital inlet valve, is extended beyond pure volume flow adjustment. The functionality of the outlet valve, e.g. a digital outlet valve, is extended beyond pure high-pressure control. As a result, the high-pressure pump can be operated in such a way, e.g. on a 3-cylinder engine, despite a 1:1 drive ratio between the crankshaft and the drive shaft and abnormal synchronization, that a sufficiently accurate injection quantity can be achieved, thereby allowing alternative transmission ratios for the pump drive. For example, instead of being operated by the camshaft with a 2:1 ratio between the engine speed and the speed of the pump shaft, the high-pressure pump can be operated by other available drive shafts at different, non-synchronous speeds. By using such "non-synchronous", higher speeds, e.g. with a ratio of 1:1 between the engine speed and the speed of the pump shaft on a 3-cylinder engine, it is possible to reduce torque peaks.

Moreover, the active pump valves can be used actively to shape the noise emitted during opening and closure by appropriate variation of their opening and closing points without modifying the resultant high-pressure fuel delivery quantity appropriate to requirements.

Other embodiments provide a method for injecting fuel into cylinders of an engine, by means of which pump delivery by a high-pressure pump in synchronism with injection can be achieved. According to one embodiment of the method, a high-pressure pump having a pump working space and a pump piston for compressing a fuel in the pump working space, a pressure reservoir for supplying the fuel for injection into the cylinders of the engine, an inlet valve for allowing the fuel into the high-pressure pump and an outlet valve for allowing the fuel out of the high-pressure pump are provided. A high-pressure volume of the fuel in the high-pressure pump is produced during a work cycle of the engine. The high-pressure volume of the fuel is moreover delivered into the pressure reservoir by the high-pressure pump during the work cycle of the engine. An injection volume of the fuel is furthermore injected into one of the cylinders during the work cycle of the engine. The high-pressure volume of the fuel produced by the high-pressure pump during the work cycle corresponds to the injection volume of the fuel taken from the pressure reservoir during the work cycle. Moreover, a different high-pressure volume of the fuel per pump stroke is delivered into the pressure reservoir during successive pump strokes during at least two successive work cycles. On the other hand, the injection volume taken from the pressure reservoir is constant during each of the successive work cycles.

In the text which follows, a fuel injection system is specified in which noise emissions which arise during the opening and/or closure of the inlet valve and/or of the outlet valve are reduced. According to one embodiment, the fuel injection system comprises a high-pressure pump for compressing a fuel, a pressure reservoir for supplying the fuel for injection into cylinders of an engine, an inlet valve for allowing the fuel into the high-pressure pump, and an outlet valve for allowing the fuel out of the high-pressure pump. The fuel injection system furthermore comprises a control unit for controlling the injection of the fuel into the cylinders and for controlling at least one of the inlet valve and the outlet valve. The high-pressure pump is coupled to the pressure reservoir via the outlet valve. The control unit is configured to control the at least one of the inlet valve and the outlet valve in such a way that times between a first successive opening and/or closure of the at least one of the inlet valve and the outlet valve and a second successive opening and/or closure of the at least one of the inlet valve and the outlet valve are different, thus allowing noise emissions which arise during the opening and/or closure of the at least one of the inlet valve and the outlet valve to be significantly reduced.

According to another embodiment of the fuel injection system, the control unit is configured to set the times between a first successive opening and/or closure of the at least one of the inlet valve and the outlet valve and a second successive opening and/or closure of the at least one of the inlet valve and the outlet valve in such a way that noise emissions which arise during the opening and/or closure of the at least one of the inlet valve and the outlet valve are below a limit value.

FIG. 1 shows one embodiment of a fuel injection system 10, which can be configured as a common rail fuel injection system, for example. The fuel injection system comprises a high-pressure pump 100 having a pump working space 101 for compressing a fuel. The high-pressure pump has a pump piston 102, which is supported on a tappet by means of a spring. The tappet is arranged movably in a tappet guide. To compress the fuel in the pump working space, the pump piston performs a complete up-and-down movement in the pump working space 101 during each pump stroke. To move the pump piston, the tappet is coupled to a drive shaft. The drive shaft can have one or more cams, on which the tappet rests via a roller. During rotation of the drive shaft, the rotary motion of the shaft is converted into a reciprocating motion of the piston by the cam.

The fuel injection system 10 furthermore has a pressure reservoir 110 for supplying the fuel for injection into cylinders of an engine. An inlet valve 120 is provided in a fuel inlet duct 150 in order to allow fuel into the high-pressure pump 100. The fuel inlet duct is connected to a tank 160. An outlet valve 130 for allowing the fuel out of the high-pressure pump 100 is provided in a fuel outlet duct 170. The high-pressure pump 100 is coupled to the pressure reservoir 110 via the outlet valve 130 and the fuel outlet duct 170.

One or preferably a plurality of injectors 180, which are arranged on the cylinders of an internal combustion engine and by means of which the fuel is injected into the cylinders of the internal combustion engine, are connected to the high-pressure reservoir 110. The pressure reservoir 110 is coupled to the tank 160 via a pressure compensating valve 190 and a fuel return line. If the pressure in the pressure reservoir 110 becomes too high, fuel can thus be fed back into the tank 160.

Figure 2:
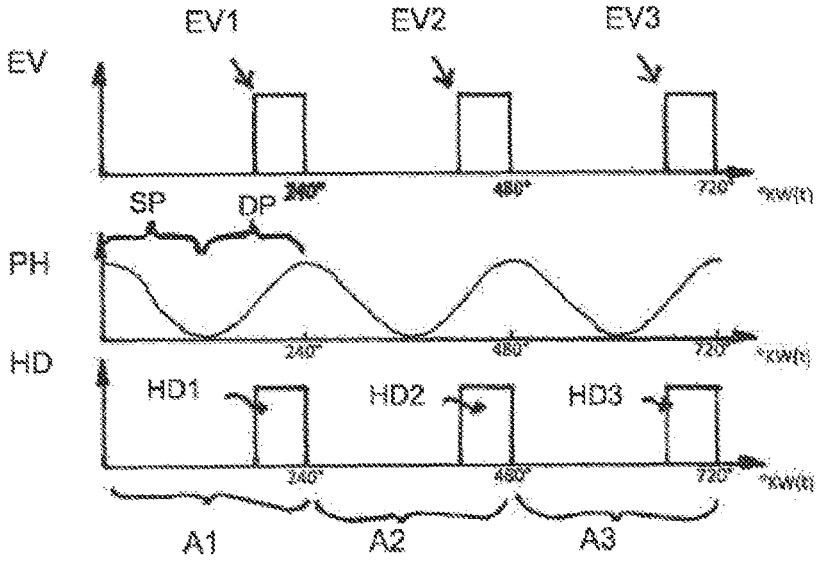
FIG. 2 shows high-pressure volume production appropriate to requirements per work cycle of a high-pressure pump during operation on a drive shaft.

FIG. 2 shows high-pressure volume production of the fuel by the high-pressure pump 100 in a manner appropriate to requirements. In the illustrative embodiment shown in FIG. 2, the high-pressure pump is driven with a transmission ratio of 2:1 on a drive shaft with triple cams and is connected to a 3-cylinder, 4-stroke internal combustion engine. In the first diagram in FIG. 2, an injection volume EV of the fuel, or the high-pressure volume which is taken from the pressure reservoir, is plotted against the degrees of crank angle (° KW) of the drive shaft. The injection volume EV is represented as a rectangular area. A first work cycle or work period A1 of the engine extends from 0° KW to 240° KW. At the end of the first work cycle A1, injection volume EV1 for injection into the first cylinder is taken from the pressure reservoir 110. The second work cycle or work period A2 of the engine extends from 240° KW to 480° KW. At the end of the second work cycle A2, another injection volume EV2 for injection into the second cylinder is taken from the pressure reservoir 110. The third work cycle/work period A3 of the engine extends from 480° KW to 720° KW. At the end of the third work period A3, injection volume EV3 is taken from the pressure reservoir and injected into a third cylinder of the engine.

A pump stroke PH of the high-pressure pump, which in each case has a suction phase SP and a discharge phase DP, is shown in the second diagram in FIG. 2. In the third diagram, the high-pressure volume of the fuel produced by the high-pressure pump during each work cycle is plotted against ° KW. At the end of the first work cycle A1, the high-pressure pump supplies high-pressure volume HD1. At the end of the second work cycle A2, the high-pressure pump supplies high-pressure volume HD2 for delivery into the pressure reservoir. At the end of the third work cycle A3 of the engine, the high-pressure pump 100 supplies high-pressure volume HD3 for delivery into the pressure reservoir 110.

In the example of a 3-cylinder, 4-stroke internal combustion engine shown in FIG. 2, two revolutions at the crankshaft equate to three work cycles or work periods at the 3-cylinder engine. Every 240° KW, an injection volume EV1, EV2 or EV3 is injected into one of the cylinders. As becomes apparent from FIG. 2, there is a delivery stroke of the high-pressure pump in synchronism with the injection process, with the result that the high-pressure volume HD1, HD2 and HD3 produced corresponds to the injection volume EV1, EV2 and EV3 taken from the high-pressure reservoir 110. The high-pressure volume production and the high-pressure volume discharge take place at the same times, thereby ensuring high-pressure volume production appropriate to requirements in the fuel injection system in each work cycle.

In the example shown in FIG. 2, the transmission ratio of the drive shaft of the high-pressure pump and the number of cams on the drive shaft are such that the pump frequency corresponds to the frequency of the main injection. As long as the pump is operated by the camshaft and hence at half the speed of the crankshaft, i.e. with a transmission ratio of 2:1 of the engine to the shaft, the number of cams corresponds to the number of cylinders of an internal combustion engine operated by the 4-stroke method. However, if the high-pressure pump is operated by some other drive shaft, e.g. a shaft with a transmission ratio of 1:1, e.g. by a balancer shaft, the conventional synchronization between the high-pressure volume produced by the high-pressure pump and the injection volume taken from the pressure reservoir is no longer possible in the case of a 3-cylinder, 4-stroke internal combustion engine.

Figure 3:
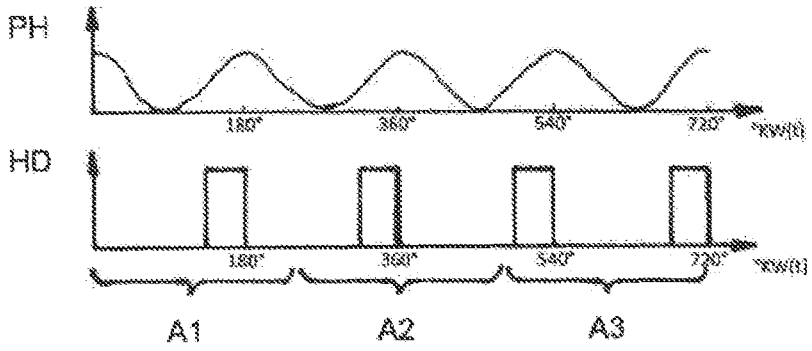
FIG. 3 shows high-pressure volume production inappropriate to requirements per work cycle during operation of a high-pressure pump on a drive shaft.

In the illustrative embodiment shown in FIG. 3, the high-pressure pump is not operated with a drive shaft at a transmission ratio of 2:1 but with a drive shaft with double cams and a transmission ratio of 1:1. In the first diagram in FIG. 3, the pump stroke PH of a high-pressure pump is plotted against ° KW. In the second diagram, the high-pressure volume of the fuel produced by the high-pressure pump in each work cycle of 240° KW is shown. The high-pressure volume is produced by the high-pressure pump during the discharge phase of the pump in each of the three work cycles A1, A2 and A3. The high-pressure pump or the inlet and outlet valves are set in such a way that the sum of the high-pressure volume produced in the respective discharge phases corresponds to the injection volume taken from the pressure reservoir at the end of the three work cycles A1, A2 and A3 since there is a requirement that the volume balance for the sum of all the work periods should remain the same overall.

As becomes apparent from FIG. 3, a total of four pump strokes, for which there are only three injection events, occurs during the three work cycles when the high-pressure pump is operated on a drive shaft with double cams and a transmission ratio of 1:1. Since the volume balance between the high-pressure volume produced by the pump and the total injection volume discharged during all the work cycles should remain the same at the end of the three work cycles, the high-pressure volume produced per pump stroke in the illustrative embodiment shown in FIG. 3 is smaller than in the variant embodiment shown in FIG. 2.

In the embodiment shown in FIG. 3, too little high-pressure volume is produced by the high-pressure pump during each of the first two work periods A1 and A2 between 0 and 240° KW and 240 and 480° KW. Thus, too little fuel volume is delivered into the pressure reservoir by the high-pressure pump 100 during each of the two work periods A1 and A2 in comparison with the injection volume taken from the pressure reservoir 110, with the result that the pressure in the pressure reservoir 110 will fall.

Two pump strokes, to which only one injection event corresponds, occur in the third work cycle A3. Since too great a high-pressure volume of fuel is delivered into the pressure reservoir by the high-pressure pump, the pressure in the pressure reservoir rises. It is clear from the example shown in FIG. 3 of a fuel injection system having a high-pressure pump operated on a drive shaft with double cams and a transmission ratio of 1:1 that high-pressure volume production appropriate to requirements in each work cycle is not possible.

The functionality of the inlet valve 120 and/or of the outlet valve 130 is extended in order in this way to permit synchronous delivery of high-pressure volume of fuel into the pressure reservoir and removal of injection volume from the pressure reservoir. It is thereby possible to achieve pump delivery in synchronism with injection. The high-pressure volume production of the fuel by the high-pressure pump is shown in FIG. 4.

To achieve pump delivery in synchronism with injection, the control unit 140 controls the injection of the fuel into the cylinders in such a way that an injection volume of the fuel is injected into in each case one of the cylinders during a work cycle A1, A2, A3 of the engine. For this purpose, the high-pressure pump 100 is configured to inject a high-pressure volume of the fuel into the pressure reservoir 110 during the work cycle of the engine, e.g. during a work cycle from 240° KW. The control unit 140 controls the at least one of the inlet valve 120 and the outlet valve 130 in such a way that the high-pressure volume of the fuel produced by the high-pressure pump 100 during the work cycle A1, A2, A3 corresponds to the injection volume of the fuel taken from the pressure reservoir 110 during the same work cycle A1, A2, A3.

Figure 4:
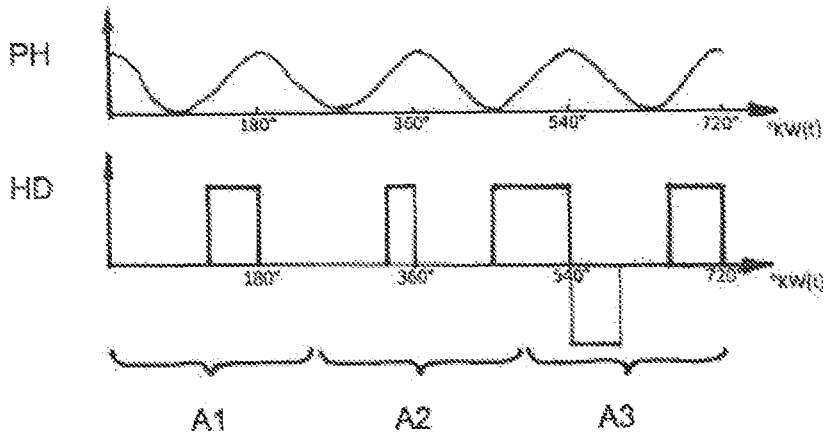
FIG. 4 shows high-pressure volume production appropriate to requirements per work cycle during operation of a high-pressure pump on a drive shaft.

In the embodiment shown in FIG. 4, a complete pump stroke PH takes place for every 180° KW. The control unit controls the at least one of the inlet and outlet valves in such a way that a different high-pressure volume of the fuel per pump stroke PH is delivered into the pressure reservoir 110 during successive pump strokes PH during at least two successive work cycles A1, A2 and A2, A3 respectively. The high-pressure volume produced per work cycle A1, A2 and A3 corresponds to the injection volume taken from the pressure reservoir in each work cycle. The control unit 140 controls the injection of the fuel into the cylinders in such a way that the injection volume EV1, EV2, EV3 taken from the pressure reservoir 110 is constant during each of the successive work cycles A1, A2, A3.

The control unit 140 controls the at least one of the inlet valve 120 and the outlet valve 130 in such a way that the respective high-pressure volume of the fuel produced by the high-pressure pump 100 during the successive work cycles of the engine corresponds to the injection volume of the fuel taken from the pressure reservoir 110 during each of the successive work cycles.

The control unit 140 controls the at least one of the inlet valve 120 and the outlet valve 130 in such a way that, during the successive work cycles A1, A2 and A3 of the engine, the at least one of the inlet valve 120 and the outlet valve 130 is opened and closed at different times during the successive work cycles A1, A2, A3.

With such an embodiment of a fuel injection system, a high-pressure volume of fuel appropriate to requirements can be produced in each work cycle of the engine by means of a high-pressure pump driven on a drive shaft with double cams and a transmission ratio of 1:1. During the first and second work cycles A1 and A2, for example, the active inlet valve 120 makes it possible for a different high-pressure volume of fuel to be supplied by the high-pressure pump in each pump stroke.

In the first work cycle A1 between 0 and 240° KW, the active inlet valve 120 is controlled by the control unit 140 in such a way that more high-pressure volume of fuel is produced with one pump stroke than in the first work cycle A1 shown in FIG. 3. In the second work cycle A2, two pump strokes coincide. The active inlet valve 120 is controlled by the control unit 140 in such a way that a relatively small high-pressure volume is supplied by the high-pressure pump during each of the two pump strokes. However, the total high-pressure volume supplied during work cycle A2 corresponds to the injection volume EV2 taken from the pressure reservoir during work cycle A2. In the third work cycle A3, the active inlet valve 120 is controlled in such a way that initially too much high-pressure volume would be produced. However, high-pressure volume of fuel which is not required in the third work cycle A3 is returned with a neutral expenditure of energy during the suction phase of the high-pressure pump.

In the third work cycle A3, the combination of the inlet valve 120 and of the outlet valve 130 is thus used to achieve delivery behavior of the pump 100 in synchronism with injection. During each of the three work cycles A1, A2 and A3, the high-pressure volume of fuel produced by the high-pressure pump corresponds to the injection volume taken from the pressure reservoir 110 during this work cycle for injection into the individual cylinders.

Through individual modification of the actual pump delivery per stroke, there is a very much better, though not perfect, ability to reestablish delivery behavior of the high-pressure pump in synchronism with injection by producing the required high-pressure volume of fuel per combustion cycle or work cycle in accordance with requirements. Through appropriate control of the inlet and/or outlet valve 120, 130, it is possible for individual pump strokes not to be used for delivery (selective stroke deactivation) and/or for the individual pump strokes to be modified individually in delivery duration for each stroke, i.e. to be lengthened or shortened, in order to produce a larger or smaller high-pressure delivery volume during the individual strokes, although this is not a matter of adapting to the dynamically changing consumption.

Figure 5:
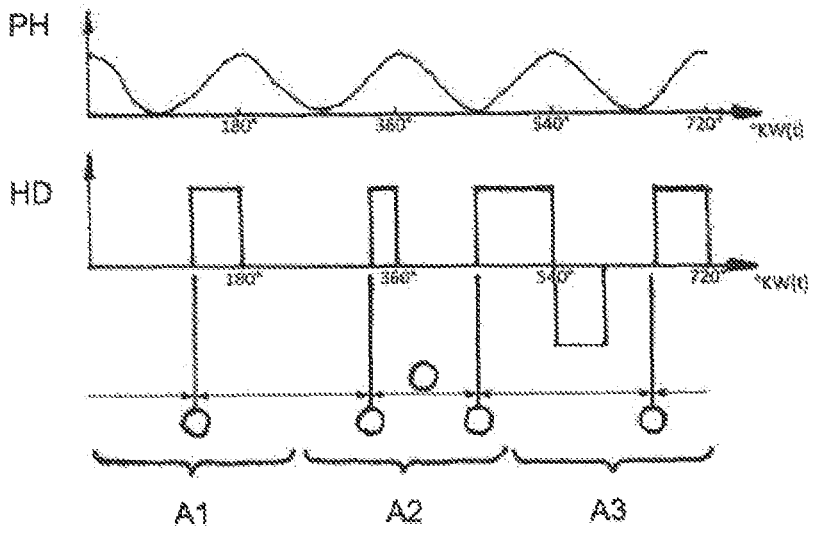
FIG. 5 shows a high-pressure volume produced in a manner appropriate to requirements during operation of a high-pressure pump on a drive shaft, with reduced noise emissions during the opening and closure of an inlet and outlet valve.

FIG. 5 shows an illustrative embodiment of a fuel injection system in which a high-pressure pump is operated on a drive shaft with double cams and a transmission ratio of 1:1. In addition to the high-pressure volume production in accordance with requirements in each work cycle, the opening and closing points of the inlet valve 120 and/or of the outlet valve 130 are varied in such a way that the perceptible noise actually emitted by the opening and closing of the valves is reduced to a bearable level without significantly affecting the volume flow balance. The noise-generating opening and closing points of the inlet and/or outlet valve 120, 130 are shifted in order to avoid a particular opening and closing frequency of the valves which can lead to troublesome noise or in order to make the noise generated at least more pleasant. The intervals between the opening and closing points of the valves can be different.

Noise emissions can be modified by suitable setting of the intervals between the opening and closing points of the valves, thus shifting the perceptible noise to a frequency which appears more pleasant or ensuring that the noise level is lower.

In this embodiment, the control unit 140 is configured to control the at least one of the inlet valve 120 and the outlet valve 130 in such a way that times between a first successive opening and/or closure of the at least one of the inlet valve 120 and the outlet valve 130 and a second successive opening and/or closure of the at least one of the inlet valve 120 and the outlet valve 130 are different. In particular, the control unit 140 is configured to set the times between a first successive opening and/or closure of the at least one of the inlet valve 120 and the outlet valve 130 and a second successive opening and/or closure of the at least one of the inlet valve 120 and the outlet valve 130 in such a way that noise emissions which arise during the opening and/or closure of the at least one of the inlet valve 120 and the outlet valve 130 are below a limit value.

The actually perceptible noise emissions can be influenced in a positive way, for example, by time-shifting, shortening or lengthening individual delivery sequences. For example, individual sound waves can be suppressed or eliminated through suitable phase displacement in order thereby to reduce or advantageously modulate the actually emitted perceptible noise. To modulate the emitted noise, the opening and closing points of the active pump valves are modified without a change in the resulting high-pressure delivery quantity appropriate to requirements.

LIST OF REFERENCE SIGNS

10 fuel injection system
100 high-pressure pump
110 pressure reservoir
120 inlet valve
130 outlet valve
140 control unit
150 fuel inlet duct
160 tank
170 fuel outlet duct
180 injector
190 pressure compensating valve
EV injection volume
PH pump stroke
HD high-pressure volume
A work cycle/work period

What is claimed is:

1. A fuel-injection system, comprising:

a high-pressure pump having a pump working space and a pump piston configured to compress a fuel in the pump working space, a pressure reservoir configured to supply the fuel for injection into cylinders of an engine, an inlet valve controlling a flow of the fuel into the high-pressure pump from a tank, an outlet valve controlling a flow of the fuel out of the high-pressure pump into the pressure reservoir, a control unit configured to control the injection of the fuel into the cylinders and to control operation of the inlet valve and the outlet valve, wherein the control unit controls the injection of the fuel into the cylinders such that an injection volume of the fuel is taken from the pressure reservoir and injected into one of the cylinders during each work cycle of the engine, wherein the high-pressure pump is configured to deliver a high-pressure volume of the fuel into the pressure reservoir during each work cycle of the engine, wherein the high-pressure pump is configured such that the pump piston performs a complete up-and-down motion in the pump working space during a pump stroke, wherein the control unit is configured to control the inlet valve and the outlet valve such that the high-pressure volume of the fuel produced by the high-pressure pump during each work cycle of the engine corresponds to the injection volume of the fuel taken from the pressure reservoir during the work cycle, and a different high-pressure volume of the fuel per pump stroke is delivered into the pressure reservoir during successive pump strokes during at least two successive work cycles, and wherein the control unit controls the injection of the fuel into the cylinders such that the injection volume taken from the pressure reservoir is constant during each successive work cycle.

2. The fuel injection system of claim 1, wherein the control unit is configured to control the inlet valve and the outlet valve such that the respective high-pressure volume of the fuel produced by the high-pressure pump during each of the successive work cycles of the engine corresponds to the injection volume of the fuel taken from the pressure reservoir during each of the successive work cycles of the engine.

3. The fuel injection system of claim 2, wherein the control unit is configured to control the inlet valve and the outlet valve such that the inlet valve and the outlet valve are opened and closed at different times during successive work cycles of the engine.

4. The fuel injection system of claim 1, wherein the control unit is configured to control the inlet valve and the outlet valve such that times between a first successive opening or closure of the inlet valve and the outlet valve and a second successive opening and/or closure of the inlet valve and the outlet valve are different.

5. The fuel injection system of claim 4, wherein the control unit is configured to set the times between a first successive opening or closure of the inlet valve and the outlet valve and a second successive opening or closure of the inlet valve and the outlet valve such that noise emissions which arise during the opening or closure of the inlet valve and the outlet valve are below a limit value.

6. A method for injecting fuel into cylinders of an engine, the method comprising:

providing a high-pressure pump having a pump working space and a pump piston configured to compress a fuel in the pump working space, providing a pressure reservoir configured to supply the fuel for injection into the cylinders of the engine, providing an inlet valve controlling a flow of the fuel into the high-pressure pump from a tank, and providing an outlet valve controlling a flow of the fuel out of the high-pressure pump into the pressure reservoir, producing a high-pressure volume of the fuel in the high-pressure pump during a work cycle of the engine, delivering the high-pressure volume of the fuel into the pressure reservoir by the high-pressure pump during the work cycle of the engine, injecting an injection volume of the fuel into one of the cylinders during the work cycle of the engine, the injection volume controlled by operating the inlet valve and the outlet valve during the work cycle, wherein the high-pressure volume of the fuel produced by the high-pressure pump during the work cycle corresponds to the injection volume of the fuel taken from the pressure reservoir during the work cycle, wherein a different high-pressure volume of the fuel per pump stroke is delivered into the pressure reservoir during successive pump strokes during at least two successive work cycles, and wherein the injection volume taken from the pressure reservoir is constant during each of the successive work cycles.

7. The method of claim 6, wherein the respective high-pressure volume of the fuel produced by the high-pressure pump during successive work cycles corresponds to the injection volume of the fuel taken from the pressure reservoir during each of the successive work cycles.

8. The method of claim 7, wherein, during the successive work cycles of the engine, the inlet valve and the outlet valve are opened and closed at different times during the successive work cycles of the engine.

9. The method of claim 6, wherein times between a first successive opening and/or closure of the inlet valve and the outlet valve and a second successive opening and/or closure of the inlet valve and the outlet valve are different.

10. The method of claim 9, wherein the times between a first successive opening or closure of the inlet valve and the outlet valve and a second successive opening or closure of the inlet valve and the outlet valve are set such that noise emissions which arise during the opening or closure of the inlet valve and the outlet valve are below a limit value.

* * * * *